United States Patent [19]

Gardiner

[11] 4,372,543

[45] Feb. 8, 1983

[54] CUPEL

[76] Inventor: Philip M. Gardiner, P.O. Box 5, Parlin, Colo. 81239

[21] Appl. No.: 263,601

[22] Filed: May 14, 1981

[51] Int. Cl.[3] ..... F27B 14/10; C22B 11/00; C22B 13/00

[52] U.S. Cl. ..... 266/275; 75/79; 373/122; 422/102; 432/262; 432/265

[58] Field of Search ..... 75/79, 83; 422/102; 266/242, 275, 276, 277; 13/20, 23; 432/262, 263, 264, 265; 373/117, 122

[56] References Cited

U.S. PATENT DOCUMENTS

| | | | |
|---|---|---|---|
| 777,725 | 12/1904 | Fox | 432/262 X |
| 2,383,353 | 8/1945 | Steele | 432/262 X |
| 4,202,538 | 4/1980 | Shimada et al. | 266/275 |
| 4,303,616 | 12/1981 | Kano et al. | 422/102 |

FOREIGN PATENT DOCUMENTS

| | | | |
|---|---|---|---|
| 698844 | 10/1953 | United Kingdom | 75/83 |
| 290193 | 4/1971 | U.S.S.R. | 422/102 |

*Primary Examiner*—L. Dewayne Rutledge
*Assistant Examiner*—Alan E. Schiavelli
*Attorney, Agent, or Firm*—Fulwider, Patton, Rieber, Lee & Utecht

[57] ABSTRACT

A cupel for the fire assaying of ore samples is provided having an improved configuration comprising a primary hemispherical cavity within which is disposed a secondary hemispherical cavity. The secondary cavity has a radius of curvature no greater than one half that of the primary cavity, and extends in a downward direction beyond the lowest extreme of the primary cavity. A transverse lip serves as an upper ridge for the secondary cavity.

9 Claims, 3 Drawing Figures

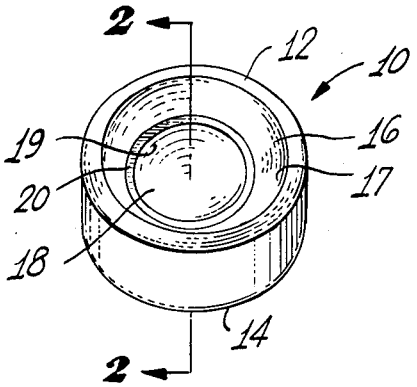
Fig. 1
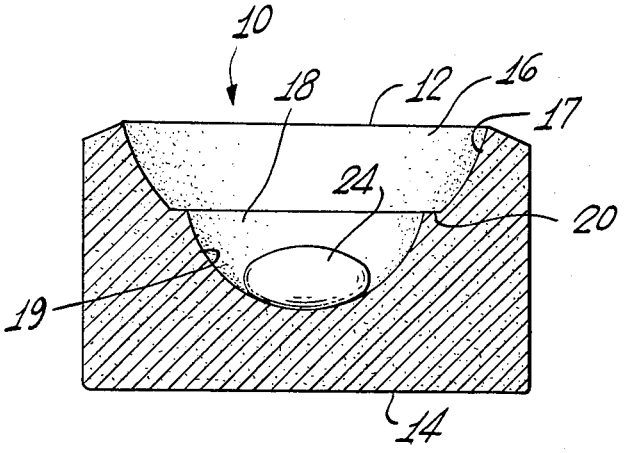
Fig. 2
Fig. 3
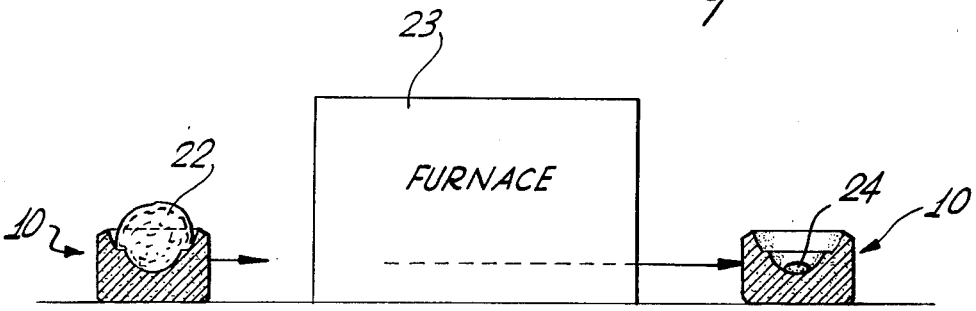

CUPEL

BACKGROUND OF THE INVENTION

The present invention relates generally to cupels and, more particularly, to cupels used in the fire assaying of metal ores.

Conventional cupels, well known in the art of cupellation, or the distillation of pure metal from an ore sample by exposure to high temperature, include a cylindrical body made of a porous material and have a single recess for holding a predetermined amount of partially refined metal secured from the ore which is to be assayed. Heat is applied to the cupel by placing it in a muffle or furnace having a temperature in excess of 300 degrees Centigrade and sufficient to oxidize the impurities so that a quantity of pure metal, known as the "dore button", is left in the cupel.

The process of cupellation has been practiced for many years. It is utilized primarily in connection with the fire assaying of precious metals but is not necessarily limited to such metals. One of the first steps in the process of fire assaying is combining a determined quantity of rock ore sample with certain pre-mixed chemicals such as litharage, soda ash, borax glass or silica. The sample and chemicals are then heated in a crucible and reduced into a "uniform melt". The addition of finely divided carbon is further reduced by the application of heat to a "final melt" which includes a quantity of lead as well as other impurities. The final melt is allowed to cool in a conically shaped mold, with the molten lead, containing the noble metal, flowing to the tip of the inverted cone shaped mold. As the final melt cools, the impurities and metal ore tend to separate, and when cooled the small end of the resultant cone, called a "bullion head", is broken off. The bullion head contains the metal ore that was contained in the original ore sample, it having been separated from a significant proportion of the impurities present in the original rock ore sample.

At this stage the bullion head is placed in a cupel which has been heated to a pre-determined temperature for quick melting of the bullion head. Conventional cupels are generally comprised of a cylindrical body made of a porous material such as bone ash, and have a single hemispherical shallow recess for holding the bullion head. The cupel with bullion head is placed in a muffle which allows air to pass over the cupel, and allows the molten lead in the bullion head to burn off or oxidize, part of which is carried off by convection currents as a gaseous waste and the remainder to be asorbed in the body of the cupel.

In the process of cupellation, it is very important that the muffle be maintained at a temperature high enough to keep the oxidation process going, this temperature being known as the "kindling temperature". The kindling temperature will be considerably above the melting point of lead (approximately 300 degrees Centigrade). As the lead content becomes proportionately less through oxidation, the proportionate amount of pure metal increases. Consequently, the kindling temperature needed to maintain the cupellation increases in direct proportion to the amount of lead oxidized. Unfortunately, by utilizing previously known cupels, one effect of the proportionately higher temperatures required to oxidize the lead is an accompanying loss of precious metal. Conventional cupels do not overcome or even mitigate this problem and given the present day cost of precious metals, considerable dollar amounts of ore are lost by excessive temperatures during cupellation.

Should the temperature of the muffle fall below the kindling temperature needed to maintain cupellation, a lead oxide skin forms on the surface of the precious metal-lead alloy in the cupel. In order to evaporate the lead oxide skin and re-start cupellation, the temperature of the muffle (and consequently the cupel and its contents) must be raised far above the temperature normally required to commence cupellation. This higher temperature results in an even greater loss of precious metal.

The value of precious metals is such that even the loss of a fraction of a troy-ounce in the assaying process can amount to a significant sum. Accordingly, there is a need for a more efficient apparatus for practicing the cupellation process. As will become apparent from the following, the present invention fulfills that need, and further provides other related advantages.

SUMMARY OF THE INVENTION

The present invention resides in an improved cupel used in the fire assaying of ore samples which allows the fire assaying or cupellation process to be conducted at reduced temperatures with resulting increased efficiency and greater conservation of the metals contained in the ore. The cupel comprises a body in which there is disposed a primary cavity, and disposed within the primary cavity is a secondary cavity.

More specifically, the cupel has a generally cylindrical homogeneous body with top and bottom sides, the top side having a primary cavity substantially hemispherical in shape extending downward toward the bottom side. Disposed entirely within the primary cavity is a secondary substantially hemispherical cavity with a radius of curvature no greater than one-half that of the primary cavity. The secondary cavity extends in a downward direction beyond the lowest extreme of the primary cavity. A transverse lip serves as an upper ridge for the secondary cavity.

The secondary cavity is substantially symmetrically oriented with respect to the vertical axis of the primary cavity. The extent of the downward extension of the primary cavity is no greater than one-half the total depth of the cupel body, and the extent of the downward extension of the secondary cavity beyond the primary cavity is no greater than one-quarter the total depth of the body.

The secondary cavity serves as a reverbatory furnace and reflects heat to the contents of the cupel. The novel configuration of the present invention also controls the overheating of the pure metal enabling the cupellation process to proceed at a lower temperature.

Other features and advantages of the present invention will become apparent from the following detailed description taken in conjunction with the accompanying drawings which illustrate by way of example the principles of the invention.

BRIEF DESCRIPTION OF THE DRAWINGS

FIG. 1 is a perspective view of a cupel embodying the present invention;

FIG. 2 is an enlarged, sectional view taken substantially along line 2—2 of FIG. 1; and FIG. 3 is a reduced, sectional view of the cupel shown in FIG. 1 with one cupel containing a bullion head prior to cupellation in a muffle, and one cupel containing a dore button resulting from cupellation.

DETAILED DESCRIPTION

As is shown in the exemplary drawings, the present invention is embodied in a novel and functional configuration for a cupel, indicated generally by reference numeral 10. The body of the cupel 10 is substantially cylindrical and homogeneous with a top side 12 and a bottom side 14. Disposed within the body of the cupel is a downwardly extending primary cavity 16 which extends downward from the top side 12 toward the bottom side 14. The primary cavity 16 is substantially hemispherical in shape and defined by circumferential interior sidewalls 17. Disposed within the primary cavity 16 is a secondary cavity 18 which extends in a downward direction toward the bottom side 14, beyond the lowest extreme of the primary cavity. The secondary cavity is substantially hemispherical in shape with a radius of curvature not greater than one-half that of the primary cavity, and is defined by circumferential interior sidewalls 19.

The secondary cavity 18 is defined from the primary cavity 16 by a transverse lip 20 which forms the lowest extremity of the primary cavity 16 and which also serves as an upper ridge for the secondary cavity 18. In the preferred embodiment of the present invention, the secondary cavity 18 is substantially symmetrical with the primary cavity 16 relative to the vertical axis of the primary cavity, and extends beyond the lowest extreme of the primary cavity. Accordingly, the secondary cavity 18 is formed along the same vertical axis as the primary cavity, but at a lower horizontal axis than the primary cavity 16.

The interior sidewalls 17 of the primary cavity 16 are of proportionally greater circumference than the interior sidewalls 19 of the secondary cavity 18. In the preferred embodiment, the primary cavity 16 extends no greater than one-half the total depth of the cupel body, and the secondary cavity 18 extends in a downward direction no greater than one quarter of the total depth. As such, the primary cavity and the secondary cavity together extend no farther than three-quarters of the way into the body of the cupel.

Because of the unique configuration described above, the secondary cavity 18 functions as a reverbatory furnace, reflecting heat into the materials placed therein. The principal of the reverbatory furnace of the present invention is that it reflects heat to the contents of the cupel which have a relatively higher specific heat than the body of the cupel, thus conducting most of the available heat into, for example, the bullion head.

As shown in FIG. 3, a bullion head 22 is loaded into the cupel 10. The cupel is then placed in a muffle 23 and the bullion head is reduced by cupellation to a quality assay specimen known as a dore button 24. Although the dore button 24 is not a feature of this invention, it is depicted to show how the interior walls 19 of the secondary cavity 18 are in such close proximity to the bullion head 22, which is the subject matter of the cupellation process, that much more heat is reflected into the bullion head. The radius of curvature of the secondary cavity 18 is of such proportion to the curvature of the primary cavity 16 so as to reflect the heat contained in the body of the cupel as a point of focus into the secondary cavity, permitting a lower temperature in actual cupellation and resulting in a reduction in losses of precious metal during cupellation.

The bullion head 22 is placed in the pre-heated cupel 10 and the cupel and its contents are placed in the muffle 23. The cupel, when in the muffle, is kept at least at kindling temperature to oxidize the impurities present in the bullion head. The cupellation process proceeds until virtually all of the impurities contained in the bullion head are oxidized or absorbed in the cupel body. Absorption is facilitated by manufacture of the cupel from a porous material such as bone ash. The product of the cupellation process is the assayable metal known as the dore button 24.

Other configurations of cupel can be utilized to practice the invention; however, as the secondary cavity deviates from the preferred embodiment described above, the efficiency of the heating process and advantages conferred by the invention will be proportionately lost.

From the foregoing, it will be appreciated that the secondary cavity of the present invention enables the cupellation process to be conducted more efficiently, utilizing relatively lower temperatures, while oxidizing at least the same, if not more, impurities and conserving amounts of valuable ore from oxidation. Further, cupels embodying the present invention can be manufactured just as economically and of the same materials as conventional cupels. It will also be appreciated that, although a specific embodiment of the invention has been described herein for purposes of illustration, various modifications can be made without departing from the spirit and scope of the invention, Accordingly, the invention is not limited except as by the appended claims.

I claim:

1. A cupel comprising a body in which there is a downwardly extending primary cavity, and disposed within said primary cavity, a downwardly extending secondary cavity which extends beyond the lowest extreme of said primary cavity, said primary cavity being substantially hemispherical, and said secondary cavity being substantially hemispherical and symmetrically disposed within said primary cavity.

2. The cupel of claim 1, wherein the radius of curvature of said secondary cavity is no greater than one-half the radius of curvature of said primary cavity.

3. The cupel of claim 1, wherein said secondary cavity is defined from said primary cavity by a transverse lip.

4. A cupel comprising a body in which there is a downwardly extending primary cavity, and disposed within said primary cavity, a downwardly extending secondary cavity which extends beyond the lowest extreme of said primary cavity, the extent of the downward extension of said primary cavity being no greater than one-half the total depth of said body, and the extent of the downward extension of said secondary cavity beyond said primary cavity being no greater than one-quarter the total depth of said body.

5. A cupel comprising:

a body with top and bottom sides, said top side having a substantially hemispherical primary cavity extending downward toward said bottom side, and disposed entirely within said primary cavity, a substantially hemispherical secondary cavity extending beyond the lowest extreme of said primary cavity.

6. The cupel of claim 5, wherein said secondary cavity is defined from said primary cavity by a transverse lip.

7. The cupel of claim 5, wherein said secondary cavity is substantially symmetrically oriented with respect to said primary cavity relative to the vertical axis of said primary cavity.

8. The cupel of claim 5, wherein said secondary cavity is no greater than one-half the radius of curvature of said primary cavity.

9. A cupel comprising:

a cylindrical homogeneous body with top and bottom sides, said top side having a primary cavity substantially hemispherical in shape extending downward toward said bottom side, and disposed entirely within said primary cavity, a substantially hemispherical secondary cavity extending in a downward direction beyond said primary cavity toward said bottom side, said secondary cavity having a radius of curvature no greater than one-half that of said primary cavity and said primary cavity being defined from said secondary cavity by a transverse lip.

* * * * *